US008789581B2

(12) United States Patent
Fripp et al.

(10) Patent No.: US 8,789,581 B2
(45) Date of Patent: Jul. 29, 2014

(54) FLOW CONTROL DEVICES ON EXPANDABLE TUBING RUN THROUGH PRODUCTION TUBING AND INTO OPEN HOLE

(71) Applicant: Halliburton Energy Services, Inc., Houston, TX (US)

(72) Inventors: Michael Fripp, Carrollton, TX (US); John Gano, Carrollton, TX (US); Peter Besselink, Enschede (NL); Wilfried Van Moorleghem, Herk (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/049,631

(22) Filed: Oct. 9, 2013

(65) Prior Publication Data

US 2014/0090857 A1 Apr. 3, 2014

Related U.S. Application Data

(63) Continuation of application No. 13/672,968, filed on Nov. 9, 2012.

(60) Provisional application No. 61/602,111, filed on Feb. 23, 2012.

(51) Int. Cl.

| | |
|---|---|
| ***E21B 33/12*** | (2006.01) |
| ***E21B 43/10*** | (2006.01) |
| ***E21B 43/08*** | (2006.01) |
| ***E21B 33/124*** | (2006.01) |
| ***E21B 33/10*** | (2006.01) |
| ***E21B 43/12*** | (2006.01) |
| ***E21B 34/06*** | (2006.01) |
| ***E21B 33/13*** | (2006.01) |

(52) U.S. Cl.

CPC ..... *E21B 33/10* (2013.01); *E21B 43/103* (2013.01); *E21B 43/08* (2013.01); *E21B 33/124* (2013.01); *E21B 43/12* (2013.01); *E21B 34/06* (2013.01); *E21B 33/1208* (2013.01); *E21B 33/13* (2013.01); *E21B 43/106* (2013.01)

USPC ..... 166/127; 166/386; 166/387

(58) Field of Classification Search

CPC . E21B 33/124; E21B 33/1208; E21B 43/103; E21B 43/106; E21B 43/12; E21B 23/106; E21B 33/134

USPC ..... 166/127, 194, 386, 387, 206, 285

See application file for complete search history.

(56) References Cited

U.S. PATENT DOCUMENTS

| | | | | |
|---|---|---|---|---|
| 4,484,625 | A * | 11/1984 | Barbee, Jr. | 166/185 |
| 2002/0092648 | A1 | 7/2002 | Johnson et al. | |
| 2005/0279514 | A1 | 12/2005 | Metcalfe | |
| 2008/0149349 | A1 | 6/2008 | Hiron et al. | |
| 2010/0243277 | A1 | 9/2010 | Ring | |
| 2011/0214855 | A1 | 9/2011 | Hart et al. | |

FOREIGN PATENT DOCUMENTS

WO 2013126192 A1 8/2013

OTHER PUBLICATIONS

International Search Report and Written Opinion for PCT/US2013/023733 dated Jun. 26, 2013.

* cited by examiner

*Primary Examiner* — Yong-Suk (Philip) Ro

(74) *Attorney, Agent, or Firm* — McDermott Will & Emery LLP; John W. Wustenberg

(57) ABSTRACT

An example downhole completion system includes a first sealing structure arranged within an open hole section of a wellbore and being movable between a contracted configuration and an expanded configuration, a second sealing structure arranged axially adjacent the first sealing structure and also being movable between a contracted configuration and an expanded configuration, and a flow control device arranged between the first and second sealing structures and configured to provide a flow path for fluids to communicate between a surrounding subterranean formation and an interior of the downhole completion system.

16 Claims, 5 Drawing Sheets

FLOW CONTROL DEVICES ON EXPANDABLE TUBING RUN THROUGH PRODUCTION TUBING AND INTO OPEN HOLE

CROSS-REFERENCE TO RELATED APPLICATIONS

This application is a continuation of U.S. application Ser. No. 13/672,968, filed on Nov. 9, 2012, which claims priority to U.S. Provisional Patent App. No. 61/602,111, filed on Feb. 23, 2012.

BACKGROUND

This present invention relates to wellbore completion operations and, more particularly, to a downhole completion assembly for sealing and supporting an open hole section of a wellbore and providing flow control through the downhole completion assembly.

Oil and gas wells are drilled into the Earth's crust and extend through various subterranean zones before reaching producing oil and/or gas zones of interest. Some of these subterranean zones may contain water and it is often advantageous to prevent the subsurface water from being produced to the surface with the oil/gas. In some cases, it may be desirable to block gas production in an oil zone, or block oil production in a gas zone. Where multiple oil/gas zones are penetrated by the same borehole, it is sometimes required to isolate the several zones, thereby allowing separate and intelligent production control from each zone for most efficient production. In traditionally completed wells, where a casing string is cemented into the wellbore, external packers are commonly used to provide annular seals or barriers between the casing string and the centrally-located production tubing in order to isolate the various zones.

It is increasingly common, however, to employ completion systems in open hole sections of oil and gas wells. In these wells, the casing string is cemented only in the upper portions of the wellbore while the remaining portions of the wellbore remain uncased and generally open (i.e., "open hole") to the surrounding subterranean formations and zones. Open hole completions are particularly useful in slanted wellbores that have borehole portions that are deviated and run horizontally for thousands of feet through producing and non-producing zones. Some of the zones traversed by the slanted wellbore may be water zones which must be generally isolated from any hydrocarbon-producing zones. Moreover, the various hydrocarbon-producing zones often exhibit different natural pressures and must be intelligently isolated from each other to prevent flow between adjacent zones and to allow efficient production from the low pressure zones.

In open hole completions, annular isolators are often employed along the length of the open wellbore to allow selective production from, or isolation of, the various portions of the producing zones. As a result, the formations penetrated by the wellbore can be intelligently produced, but the wellbore may still be susceptible to collapse or unwanted sand production. To prevent the collapse of the wellbore and sand production, various steps can be undertaken, such as installing gravel packs and/or sand screens. More modern techniques include the use of expandable tubing in conjunction with sand screens. These types of tubular elements may be run into uncased boreholes and expanded once they are in position using, for example, a hydraulic inflation tool, or by pulling or pushing an expansion cone through the tubular members.

In some applications, the expanded tubular elements provide mechanical support to the uncased wellbore, thereby helping to prevent collapse. In other applications, contact between the tubular element and the borehole wall may serve to restrict or prevent annular flow of fluids outside the production tubing. However, in many cases, due to irregularities in the borehole wall or simply unconsolidated formations, expanded tubing and screens will not prevent annular flow in the borehole. For this reason, annular isolators, such as casing packers, are typically needed to stop annular flow. Use of conventional external casing packers for such open hole completions, however, presents a number of problems. They are significantly less reliable than internal casing packers, they may require an additional trip to set a plug for cement diversion into the packer, and they are generally not compatible with expandable completion screens.

Efforts have been made to form annular isolators in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. Moreover, the thickness of the rubber sleeve must be limited since it adds to the overall tubing diameter, which must be small enough to extend through small diameters as it is run into the borehole. The maximum size is also limited to allow the tubing to be expanded in a nominal or even undersized borehole. On the other hand, in washed out or oversized boreholes, normal tubing expansion is not likely to expand the rubber sleeve enough to contact the borehole wall and thereby form a seal. To form an annular seal or isolator in variable sized boreholes, adjustable or variable expansion tools have been used with some success. Nevertheless, it is difficult to achieve significant stress in the rubber with such variable tools and this type of expansion produces an inner surface of the tubing which follows the shape of the borehole and is not of substantially constant diameter.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This present invention relates to wellbore completion operations and, more particularly, to a downhole completion assembly for sealing and supporting an open hole section of a wellbore and providing flow control through the downhole completion assembly.

The present invention provides a downhole completion system that features an expandable sealing structure and corresponding internal truss structure which are capable of being run through existing production tubing and subsequently expanded to clad and support the inner surface of an open hole section of a wellbore. Once the sealing structure is run to its proper downhole location, it may be expanded by any number of fixed expansion tools that are also small enough to axially traverse the production tubing. In operation, the expanded sealing structure may be useful in sealing the inner radial surface of the open borehole, thereby preventing the influx of unwanted fluids, such as water. The internal truss structure may be arranged within the sealing structure and useful in supporting the expanded sealing structure and otherwise providing collapse resistance to the corresponding open hole section of the wellbore. The downhole completion system may include multiple sealing and internal truss structures deployed downhole in adjacent locations. In such embodiments, the adjacent lengths may either overlap a short distance or a gap may be formed therebetween. Suitable flow control devices may be arranged at these junctions or locations such that the downhole completion system provides intelligent production and/or injection operations.

The disclosed downhole completion system may prove advantageous in that it is small enough to be able to be run-in through existing production tubing and into an open hole section of a wellbore. When expanded, the disclosed downhole completion system may provide sufficient expansion within the open hole section to adequately seal off sections or portions thereof and further provide wellbore collapse resistance. Once properly installed, the exemplary downhole completion system may stabilize, seal, and/or otherwise isolate the open hole section for long-term intelligent production operations. As a result, the life of a well may be extended, thereby increasing profits and reducing expenditures associated with the well. As will be apparent to those skilled in the art, the systems and methods disclosed herein may advantageously salvage or otherwise revive certain types of wells, such as watered-out wells, which were previously thought to be economically unviable.

Figure 1:
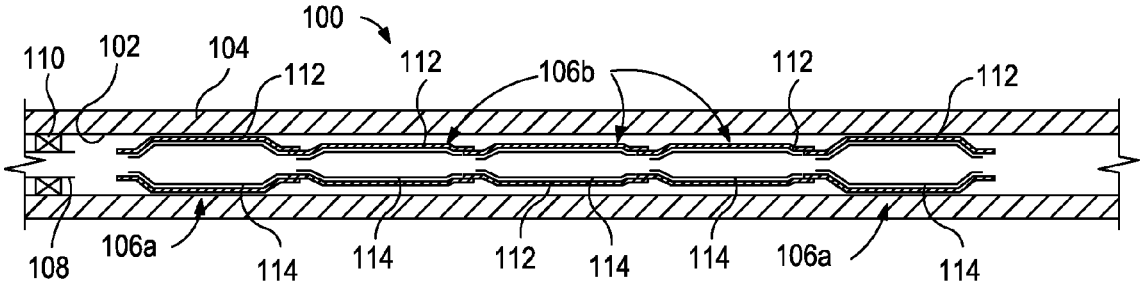
FIG. 1 illustrates an exemplary downhole completion system, according to one or more embodiments.

Referring to FIG. 1, illustrated is an exemplary downhole completion system 100, according to one or more embodiments disclosed. As illustrated, the system 100 may be configured to be arranged in an open hole section 102 of a wellbore 104. As used herein, the term or phrase "downhole completion system" should not be interpreted to refer solely to wellbore completion systems as classically defined or otherwise generally known in the art. Instead, the downhole completion system may also refer to or be characterized as a downhole fluid transport system. For instance, the downhole completion system 100, and the several variations described herein, may not necessarily be connected to any production tubing or the like. As a result, in some embodiments, fluids conveyed through the downhole completion system 100 may exit the system 100 into the open hole section 102 of the wellbore, without departing from the scope of the disclosure.

While FIG. 1 depicts the system 100 as being arranged in a horizontally-oriented portion of the wellbore 104, it will be appreciated that the system 100 may equally be arranged in vertical or slanted portions of the wellbore 104, or any other angular configuration therebetween, without departing from the scope of the disclosure. As illustrated, the downhole completion system 100 may include various interconnected sections or lengths extending axially within the wellbore 104. Specifically, the system 100 may include one or more end sections 106*a* (two shown) and one or more middle sections 106*b* coupled to or otherwise generally interposing the end sections 106*a*. In some embodiments, the end and middle sections 106*a,b* may be coupled or otherwise attached together at their respective ends in order to provide an elongate conduit or structure within the open hole section 102 of the wellbore 104. In other embodiments, however, adjacent lengths of end and/or middle sections 106*a,b* may be axially offset from each other by a short distance and one or more flow control devices (not shown) may bridge the gap and thereby provide intelligent production capabilities at such points.

While only two end sections 106*a* and three middle sections 106*b* are depicted in FIG. 1, it will be appreciated that the system 100 can include more or less end and/or middle sections 106*a,b* without departing from the scope of the disclosure. Indeed, the system 100 can be progressively extended by adding various sections thereto, such as additional end sections 106*a* and/or additional middle sections 106*b*, until a desired or predetermined length of the system 100 is achieved within the open hole section 102. Those skilled in the art will recognize that there is essentially no limit as to how long the system 100 may be extended to, only being limited by the overall length of the wellbore 104, the size and amount of overlapping sections, finances, and time.

In some embodiments, the end sections 106*a* may be sized such that they are expandable to seal against or otherwise clad the inner radial surface of the open hole section 102 when properly installed, thereby providing a corresponding isolation point along the axial length of the wellbore 104. As discussed in greater detail below, one or more of the end sections 106*a* may include an elastomer or other sealing element disposed about its outer radial surface in order to sealingly engage the inner radial surface of the open hole section 102. The middle sections 106*b* may or may not be configured to seal against the inner radial surface of the open hole section 102. For example, in some embodiments, one or more of the middle sections 106*b* may be characterized as "straddle" elements configured with a fixed outer diameter that does not seal against or otherwise engage the inner radial surface of the open hole section 102 when fully expanded. Such straddle elements may be useful in providing lengths of connective tubing or conduit for sealingly connecting the end sections 106*a* and providing fluid communication therethrough.

In other embodiments, however, one or more of the middle sections 106*b* may be characterized as "spanner" elements configured with a fixed outer diameter and intended to span a washout portion of the open hole section 102. Such spanner elements may exhibit variable sealing capabilities by having a sealing element (not shown) disposed about its outer radial surface. The sealing element may be configured to sealingly engage the variable inner radial surface of the open hole section 102 where washouts may be present. In yet other embodiments, one or more of the middle sections 106*b* may be characterized as "sealing" elements configured to, much like the end sections 106*a*, expand to seal a portion of the wellbore 104 along the length of the open hole section 102. Such sealing elements may have an outer diameter that is matched (or closely matched) to a caliper log of the open hole section 102.

In contrast to prior art systems, which are typically run into the open hole section 102 via a cased wellbore 104, the disclosed downhole completion system 100 may be configured to pass through existing production tubing 108 extending within the wellbore 104. In some embodiments, the production tubing 108 may be stabilized within the wellbore 104 with one or more annular packers 110 or the like. As can be appreciated by those skilled in the art, the production tubing 108 exhibits a reduced diameter, which requires the system 100 to exhibit an even more reduced diameter during run-in in order to effectively traverse the length of the production tubing 108 axially. Moreover, in order to properly seal against the open hole section 102 upon proper deployment from the production tubing 108, the system 100 may be designed to exhibit a large amount of potential radial expansion.

Each section 106*a,b* of the downhole completion system 100 may include at least one sealing structure 112 and at least one truss structure 114. In other embodiments, however, the truss structure 114 may be omitted from one or more of the sections 106*a,b*, without departing from the scope of the disclosure. In some embodiments, the sealing structure 112 may be configured to be expanded and clad the inner radial surface of the open hole section 102, thereby providing a sealing function within the wellbore 104. In other embodiments, the sealing structure 112 may simply provide a generally sealed conduit or tubular for the system 100 to be connected to adjacent sections 106*a,b*.

As illustrated, at least one truss structure 114 may be generally arranged within a corresponding sealing structure 112 and may be configured to radially support the sealing structure 112 in its expanded configuration. In the event the sealing structure 112 engages the inner radial surface of the wellbore 104, the accompanying truss structure 114 may also be useful in supporting the wellbore 104 from collapse. While only one truss structure 114 is depicted within a corresponding sealing structure 112, it will be appreciated that more than one truss structure 114 may be used within a single sealing structure 112, without departing from the scope of the disclosure. Moreover, multiple truss structures 114 may be nested inside each other as there is adequate radial space in the expanded condition for multiple support structures 114 and be radially small enough to traverse the interior of the production tubing 108.

Figure 2A:
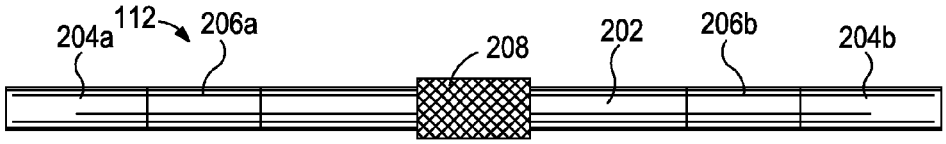
FIGS. 2A and 2B illustrate contracted and expanded sections of an exemplary sealing structure, according to one or more embodiments.
Figure 2B:
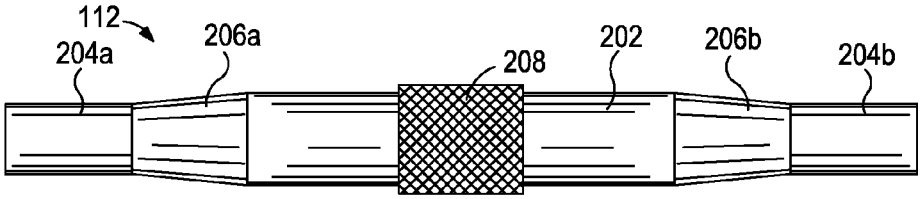

Referring now to FIGS. 2A and 2B, with continued reference to FIG. 1, illustrated is an exemplary sealing structure 112, according to one or more embodiments. Specifically, FIGS. 2A and 2B depict the sealing structure 112 in its contracted and expanded configurations, respectively. In the contracted configuration, as briefly noted above, the sealing structure 112 exhibits a diameter small enough to be run into the wellbore 104 through the reduced diameter of the production tubing 108. Once deployed from the production tubing 108, the sealing structure 112 is then able to be radially expanded into the expanded configuration.

In one or more embodiments, the sealing structure 112 may be an elongate tubular made of one or more metals or metal alloys. In other embodiments, the sealing structure 112 may be an elongate tubular made of thermoset plastics, thermoplastics, fiber reinforced composites, cementitious composites, combinations thereof, or the like. In embodiments where the sealing structure 112 is made of metal, the sealing structure 112 may be corrugated, crenulated, circular, looped, or spiraled. In at least one embodiment, the sealing structure 112 is an elongate, corrugated tubular, having a plurality of longitudinally-extending corrugations or folds defined therein. Those skilled in the art, however, will readily appreciate the various alternative designs that the sealing structure 112 could exhibit, without departing from the scope of the disclosure. For example, in at least one embodiment, the sealing structure 112 may be characterized as a frustum or the like. In embodiments where the sealing structure 112 is made from corrugated metal, the corrugations or folds defined therein are unfolded as the sealing structure 112 radially expands. In embodiments where the sealing structure 112 is made of circular metal, stretching the circular tube will result in more strain in the metal but will advantageously result in increased strength.

As illustrated, the sealing structure 112 may include or otherwise define a sealing section 202, opposing connection sections 204*a* and 204*b*, and opposing transition sections 206*a* and 206*b*. The connection sections 204*a,b* may be defined at either end of the sealing structure 112 and the transition sections 206*a,b* may be configured to provide or otherwise define the axial transition from the corresponding connector sections 204*a,b* to the sealing section 202, and vice versa.

In some embodiments, each of the sealing section 202, connection sections 204*a,b*, and transition sections 206*a,b* may be formed or otherwise manufactured differently, or of different pieces or materials that are configured to exhibit a different expansion potential (e.g., diameter) when the sealing structure 112 transitions into the expanded configuration. For instance, the corrugations (i.e., the peaks, valleys, folds, etc) of the sealing section 202 may exhibit a larger amplitude or frequency (e.g., shorter wavelength) than the corrugations of the connection sections 204*a,b*, thereby resulting in the sealing section 202 being able to expand to a greater diameter than the connection sections 204*a,b*. This may allow the various portions of the sealing structure 112 to expand at different magnitudes, thereby providing varying transitional shapes over the length of the sealing structure 112. In some embodiments, the various sections 202, 204*a,b*, 206*a,b* may be interconnected or otherwise coupled by welding, brazing, industrial adhesives, mechanical attachments, combinations thereof, or the like. In other embodiments, however, the various sections 202, 204*a,b*, 206*a,b* may be integrally-formed in a single-piece manufacture.

In at least one embodiment, the sealing structure 112 may further include a sealing element 208 disposed about at least a portion of the outer radial surface of the sealing section 202. In some embodiments, a layer of protective material or the like may surround or otherwise encase the sealing element 208. The protective material may be configured to protect the sealing element 208 from inadvertent damage or premature actuation as it is advanced through the production tubing 108. The protective material may further provide additional support to the sealing structure 112 configured to hold the sealing structure 112 under a maximum running diameter prior to placement and expansion in the wellbore 104. In operation, the sealing element 208 may radially expand as the sealing structure 112 expands and ultimately engage and seal against the inner diameter of the open hole section 102. In other embodiments, the sealing element 208 may provide lateral support for the downhole completion system 100 (FIG. 1). In some embodiments, the sealing element 208 may be arranged at two or more discrete locations along the length of the sealing section 202. The sealing element 208 may be made of an elastomer or a rubber, and may be swellable or non-swellable, depending on the application. In at least one embodiment, the sealing element 208 may be a swellable elastomer made from a mixture of a water swell and an oil swell elastomer.

In other embodiments, the material for the sealing elements 208 may vary along the sealing section 202 in order to create the best sealing available for the fluid type that the particular seal element may be exposed to. For instance, one or more bands of sealing materials can be located as desired along the length of the sealing section 202. The material used for the sealing element 208 may include swellable elastomeric, as described above, and/or bands of very viscous fluid. The very viscous liquid, for instance, can be an uncured elastomeric that will cure in the presence of well fluids. One example of such a very viscous liquid may include a silicone that cures with a small amount of water or other materials that are a combination of properties, such as a very viscous slurry of the silicone and small beads of ceramic or cured elastomeric material. The viscous material may be configured to better conform to the annular space between the expanded sealing structure 112 and the varying shape of the well bore 104 (FIG. 1). It should be noted that to establish a seal the material of the seal element 208 does not need to change properties, but only have sufficient viscosity and length in the small radial space to remain in place for the life of the well. The presence of other fillers, such as fibers, can enhance the viscous seal.

In other embodiments (not illustrated), the sealing element 208 is applied to the inner diameter of the open hole section 102 and may include such materials as, but not limited to, a shape memory material, swellable clay, hydrating gel, an epoxy, combinations thereof, or the like. In yet other embodiments, a fibrous material could be used to create a labyrinth-type seal between the outer radial surface of the sealing structure 112 and the inner diameter of the open hole section 102. The fibrous material, for example, may be any type of material capable of providing or otherwise forming a sealing matrix that creates a substantially tortuous path for any potentially escaping fluids. In yet further embodiments, the sealing element 208 is omitted altogether from the sealing structure 112 and instead the sealing section 202 itself is used to engage and seal against the inner diameter of the open hole section 102.

Figure 3A:
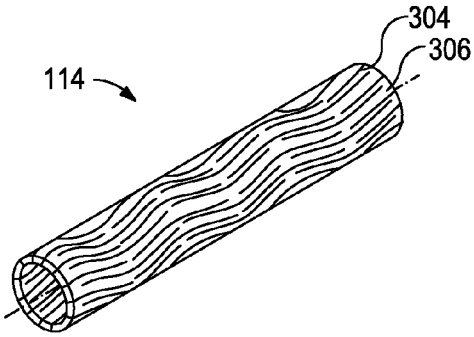
FIGS. 3A and 3B illustrate contracted and expanded sections of an exemplary truss structure, according to one or more embodiments.
Figure 3B:
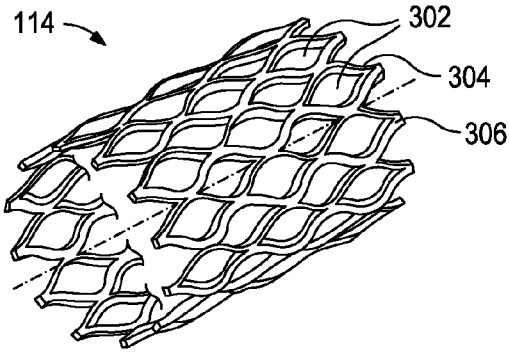

Referring now to FIGS. 3A and 3B, with continued reference to FIG. 1, illustrated is an exemplary truss structure 114, according to one or more embodiments. Specifically, FIGS. 3A and 3B depict the truss structure 114 in its contracted and expanded configurations, respectively. In its contracted configuration, the truss structure 114 exhibits a diameter small enough to be able to be run into the wellbore 104 through the reduced diameter production tubing 108. In some embodiments, the truss structure 114 in its contracted configuration exhibits a diameter small enough to be nested inside the sealing structure 112 when the sealing structure 112 is in its contracted configuration and able to be run into the wellbore 104 simultaneously with the sealing structure 112 through the production tubing 108. Once deployed from the production tubing 108, the truss structure 114 is then able to be radially expanded into its expanded configuration.

In some embodiments, the truss structure 114 may be an expandable device that defines or otherwise utilizes a plurality of expandable cells 302 that facilitate the expansion of the truss structure 114 from the contracted state (FIG. 3A) to the expanded state (FIG. 3B). In at least one embodiment, for example, the expandable cells 302 of the truss structure 114 may be characterized as bistable or multistable cells, where each bistable or multistable cell has a curved thin strut 304 connected to a curved thick strut 306. The geometry of the bistable or multistable cells is such that the tubular cross-section of the truss structure 114 can be expanded in the radial direction to increase the overall diameter of the truss structure 114. As the truss structure 114 expands radially, the bistable/multistable or multistable cells deform elastically until a specific geometry is reached. At this point the bistable/multistable cells move (e.g., snap) to an expanded geometry. In some embodiments, additional force may be applied to stretch the bistable/multistable cells to an even wider expanded geometry. With some materials and/or bistable/multistable cell designs, enough energy can be released in the elastic deformation of the expandable cell 302 (as each bistable/multistable cell snaps past the specific geometry) that the expandable cells 302 are able to initiate the expansion of adjoining bistable/multistable cells past the critical bistable/multistable cell geometry. With other materials and/or bistable/multistable cell designs, the bistable/multistable cells move to an expanded geometry with a nonlinear stair-stepped force-displacement profile.

At least one advantage to using a truss structure 114 that includes bistable/multistable expandable cells 302 is that the axial length of the truss structure 114 in the contracted and expanded configurations will be essentially the same. An expandable bistable/multistable truss structure 114 is thus designed so that as the radial dimension expands, the axial length of the truss structure 114 remains generally constant. Another advantage to using a truss structure 114 that includes bistable/multistable expandable cells 302 is that the expanded cells 302 are stiffer and will create a high collapse strength with less radial movement.

Whether bistable/multistable or not, the expandable cells 302 facilitate expansion of the truss structure 114 between its contracted and expanded configurations. The selection of a particular type of expandable cell 302 depends on a variety of factors including environment, degree of expansion, materials available, etc. Additional discussion regarding bistable/multistable devices and other expandable cells can be found in co-owned U.S. Pat. No. 8,230,913 entitled "Expandable Device for use in a Well Bore," the contents of which are hereby incorporated by reference in their entirety.

Figure 4A:
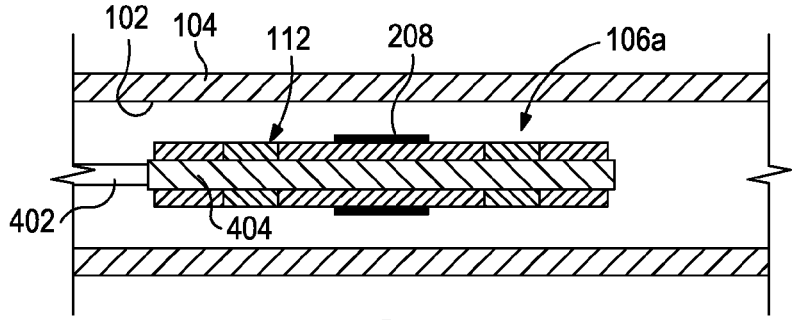
FIGS. 4A-4D illustrate progressive views of an end section of an exemplary downhole completion system being installed in an open hole section of a wellbore, according to one or more embodiments.

Referring now to FIGS. 4A-4D, with continued reference to FIGS. 1, 2A-2B, and 3A-3B, illustrated are progressive views of an end section 106*a* being installed or otherwise deployed within an open hole section 102 of the wellbore 104. While FIGS. 4A-4D depict the deployment or installation of an end section 106*a*, it will be appreciated that the following description could equally apply to the deployment or installation of a middle section 106*b*, without departing from the scope of the disclosure. As illustrated in FIG. 4A, a conveyance device 402 may be operably coupled to the sealing structure 112 and otherwise used to transport the sealing structure 112 in its contracted configuration into the open hole section 102 of the wellbore 104. As noted above, the outer diameter of the sealing structure 112 in its contracted configuration may be small enough to axially traverse the axial length of the production tubing 108 (FIG. 1) without causing obstruction thereto.

The conveyance device 402 may extend from the surface of the well and, in some embodiments, may be or otherwise utilize one or more mechanisms such as, but not limited to, wireline cable, coiled tubing, coiled tubing with wireline conductor, drill pipe, tubing, casing, combinations thereof, or the like. Prior to running the sealing structure 112 into the wellbore 104, the diameter of the open hole section 102 may be measured, or otherwise callipered, in order to determine an approximate target diameter for sealing the particular portion of the open hole section 102. Accordingly, an appropriately-sized sealing structure 112 may be chosen and run into the wellbore 104 in order to adequately seal the inner radial surface of the wellbore 104.

A deployment device 404 may also be incorporated into the sealing structure 112 and transported into the open hole section 102 concurrently with the sealing structure 112 using the conveyance device 402. Specifically, the deployment device 404 may be operably connected or operably connectable to the sealing structure 112 and, in at least one embodiment, may be arranged or otherwise accommodated within the sealing structure 112 when the sealing structure 112 is in its contracted configuration. In other embodiments, the sealing structure 112 and the deployment device 404 may be run into the wellbore 104 separately, without departing from the scope of the disclosure. For example, in at least one embodiment, the sealing structure 112 and deployment device 404 may be axially offset from each other along the length of the conveyance device 402 as they are run into the wellbore 104. In other embodiments, the sealing structure 112 and deployment device 404 may be run-in on separate trips into the wellbore 104.

The deployment device 404 may be any type of fixed expansion tool such as, but not limited to, a hydraulic setting tool (e.g., an inflatable packer element), an inflatable balloon, a mechanical packer element, an expandable swage, a scissoring mechanism, a wedge, a piston apparatus, a mechanical actuator, an electrical solenoid, a plug type apparatus (e.g., a conically shaped device configured to be pulled or pushed through the sealing structure 112), a ball type apparatus, a rotary type expander, a flexible or variable diameter expansion tool, a small diameter change cone packer, combinations thereof, or the like. Further description and discussion regarding suitable deployment devices 404 may be found in U.S. Pat. No. 8,230,913, previously incorporated by reference.

Figure 4B:
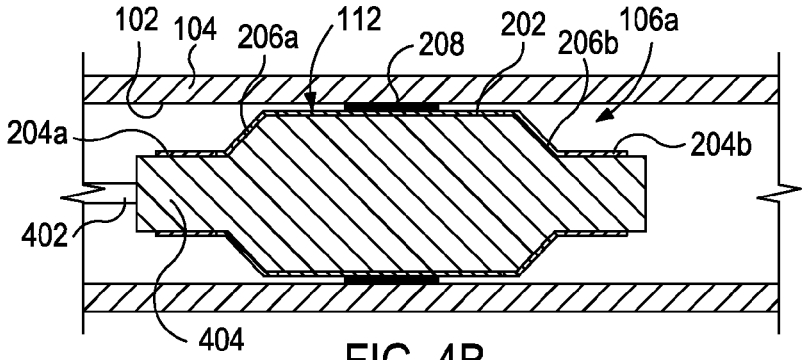

Referring to FIG. 4B, illustrated is the sealing structure 112 as it is expanded using the exemplary deployment device 404, according to one or more embodiments. In some embodiments, as illustrated, the sealing structure 112 is expanded until engaging the inner radial surface of the open hole section 102. The sealing element 208 may or may not be included with the sealing structure 112 in order to create an annular seal between the sealing structure 112 and the inner radial surface of the wellbore 104. As illustrated, the deployment device 404 may serve to deform the sealing structure 112 such that the sealing section 202, the connection sections 204*a,b*, and the transition sections 206*a,b* radially expand and thereby become readily apparent.

In embodiments where the deployment device 404 is a hydraulic setting tool, for example, the deployment device 404 may be inflated or otherwise actuated such that it radially expands the sealing structure 112. In such embodiments, the deployment device 404 may be actuated or otherwise inflated using an RDT™ (reservoir description tool) tool commercially-available from Halliburton Energy Services of Houston, Tex., USA. In other embodiments, the deployment device 404 may be inflated using fluid pressure applied from the surface or from an adjacent device arranged in the open hole section 102.

In one or more embodiments, the sealing structure 112 may be progressively expanded in discrete sections of controlled length. To accomplish this, the deployment device 404 may include short length expandable or inflatable packers designed to expand finite and predetermined lengths of the sealing structure 112. In other embodiments, the deployment device 404 may be configured to expand radially at a first location along the length of the sealing structure 112, and thereby radially deform or expand the sealing structure 112 at that first location, then deflate and move axially to a second location where the process is repeated. At each progressive location within the sealing structure 112, the deployment device 404 may be configured to expand at multiple radial points about the inner radial surface of the sealing structure 112, thereby reducing the number of movements needed to expand the entire structure 112.

Those skilled in the art will recognize that using short expansion lengths may help to minimize the chance of rupturing the sealing structure 112 during the expansion process. Moreover, expanding the sealing structure 112 in multiple expansion movements may help the sealing structure 112 achieve better radial conformance to the varying diameter of the open hole section 102.

In operation, the sealing structure 112 may serve to seal a portion of the open hole section 102 of the wellbore 104 from the influx of unwanted fluids from the surrounding subterranean formations. As a result, intelligent production operations may be undertaken at predetermined locations along the length of the wellbore 104, as will be discussed in more detail below. The sealing structure 112 may also exhibit structural resistive strength in its expanded form and therefore be used as a structural element within the wellbore 104 configured to help prevent wellbore 104 collapse. In yet other embodiments, the sealing structure 112 may be used as a conduit for the conveyance of fluids therethrough.

Figure 4C:
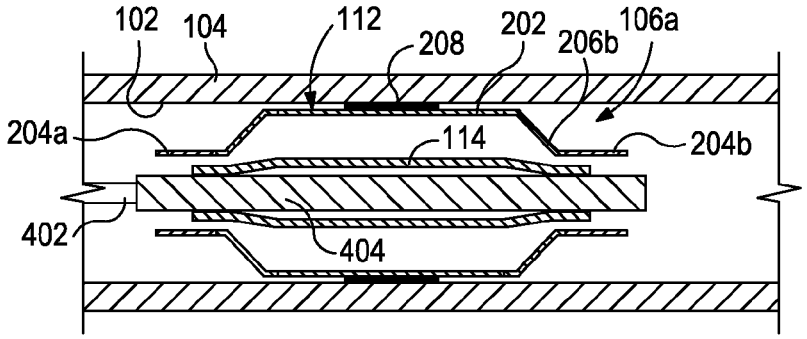

Referring to FIG. 4C, illustrated is the truss structure 114 in its contracted configuration as arranged within or otherwise being extended through the expanded sealing structure 112. As with the sealing device 112, the truss structure 114 may be conveyed or transported to the open hole section 102 of the wellbore 104 using the conveyance device 402, and may exhibit a diameter in its contracted configuration that is small enough to axially traverse the production tubing 108 (FIG. 1). In some embodiments, the truss structure 114 may be run in contiguously or otherwise nested within the sealing structure 112 in a single run-in into the wellbore 104. However, such an embodiment may not be able to provide as much collapse resistance or expansion ratio upon deployment since the available volume within the production tubing 108 may limit how robust the materials are that are used to manufacture the sealing and truss structures 112, 114.

Accordingly, in other embodiments, as illustrated herein, the truss structure 114 may be run into the open hole section 102 independently of the sealing structure 112, such as after the deployment of the sealing structure 112, and otherwise during the course of a second run-in into the wellbore 104. This may prove advantageous in embodiments where larger expansion ratios or higher collapse ratings are desired or otherwise required within the wellbore 104. In such embodiments, the downhole completion system 100 may be assembled in multiple run-ins into the wellbore 104, where the sealing structure 112 is installed separately from the truss structure 114.

In order to properly position the truss structure 114 within the sealing structure 112, in at least one embodiment, the truss structure 114 may be configured to land on, for example, one or more profiles (not shown) located or otherwise defined on the sealing structure 112. An exemplary profile may be a mechanical profile on the sealing structure 112 which can mate with the truss structure 114 to create a resistance to movement by the conveyance 402. This resistance to movement can be measured as a force, as a decrease in motion, as an increase in current to the conveyance motor, as a decrease in voltage to the conveyance motor, etc. The profile may also be an electromagnetic profile that is detected by the deployment device 404. The electromagnetic profile may be a magnet or a pattern of magnets, an RFID tag, or an equivalent profile that determines a unique location.

In some embodiments, the profile(s) may be defined at one or more of the connection sections 204*a,b* which may exhibit a known diameter in the expanded configuration. The known expanded diameter of the connection sections 204*a,b*, may prove advantageous in accurately locating an expanded sealing structure 112 or otherwise connecting a sealing structure 112 to a subsequent or preceding sealing structure 112 in the downhole completion system 100. Moreover, having a known diameter at the connection sections 204*a,b* may provide a means whereby an accurate or precise location within the system 100 may be determined.

Figure 4D:
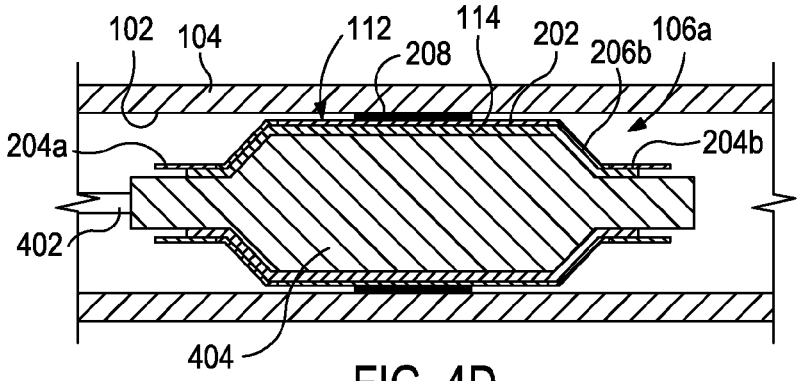

Referring to FIG. 4D, illustrated is the truss structure 114 as being expanded within the sealing device 112. Similar to the sealing device 112, the truss structure 114 may be forced into its expanded configuration using the deployment device 404. In at least one embodiment, the deployment device 404 is an inflatable packer element, and the inflation fluid used to actuate the packer element can be pumped from the surface through tubing or drill pipe, a mechanical pump, or via a downhole electrical pump which is powered via wireline cable.

As the deployment device 404 expands, it forces the truss structure 114 to also expand radially. In embodiments where the truss structure 114 includes bistable/multistable expandable cells 302 (FIG. 3B), at a certain expansion diameter the bistable/multistable expandable cells 302 reach a critical geometry where the bistable/multistable "snap" effect is initiated, and the truss structure 114 expands autonomously. Similar to the expansion of the sealing structure 112, the deployment device 404 may be configured to expand the truss structure 114 at multiple discrete locations. For instance, the deployment device 404 may be configured to expand radially at a first location along the length of the truss structure 114, then deflate and move axially to a second, third, fourth, etc., location where the process is repeated.

After the truss structure 114 is fully expanded, the deployment device 404 is radially contracted once more and removed from the deployed truss structure 114. In some embodiments, the truss structure 114 contacts the entire inner radial surface of the expanded sealing structure 112. In other embodiments, however, the truss structure 114 may be configured to contact only a few discrete locations of the inner radial surface of the expanded sealing structure 112.

In operation, the truss structure 114 in its expanded configuration supports the sealing structure 112 against collapse. In cases where the sealing structure 112 engages the inner radial surface of the wellbore 104, the truss structure 114 may also provide collapse resistance against the wellbore 104 in the open hole section 102. In other embodiments, especially in embodiments where the truss structure 114 employs bistable/multistable expandable cells 302 (FIG. 3B), the truss structure 114 may further be configured to help the sealing structure 112 expand to its fully deployed or expanded configuration. For instance, the "snap" effect of the bistable/multistable expandable cells 302 may exhibit enough expansive force that the material of the sealing structure 112 is forced radially outward in response thereto.

Figure 5:
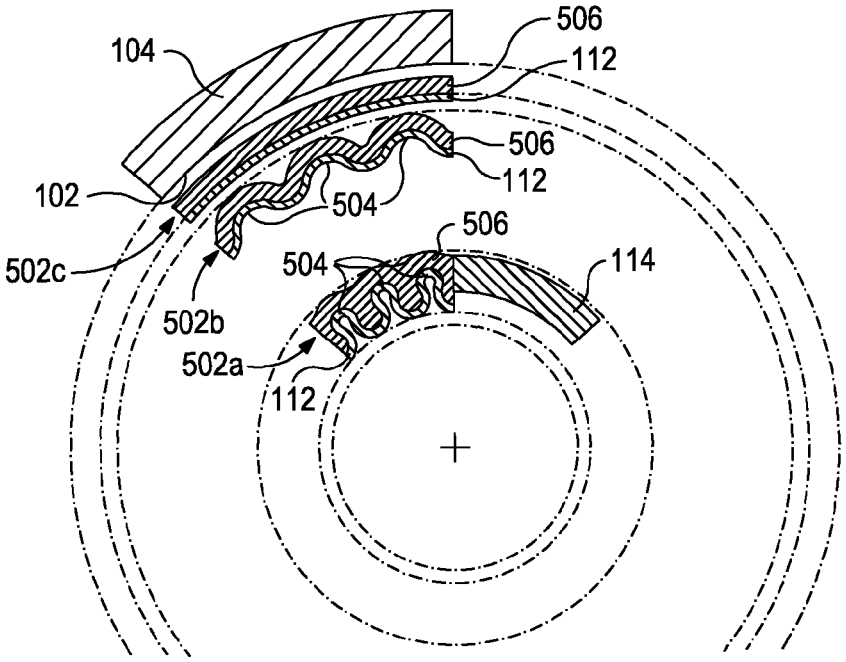
FIG. 5 illustrates a partial cross-sectional view of a sealing structure in its compressed, intermediate, and expanded configurations, according to one or more embodiments.

Referring now to FIG. 5, with continued reference to FIGS. 1, 2A-2B, and 4A-4B, illustrated is a cross-sectional view of an exemplary sealing structure 112 in progressive expanded forms, according to one or more embodiments. Specifically, the depicted sealing structure 112 is illustrated in a first unexpanded state 502*a*, a second expanded state 502*b*, and a third expanded state 502*c*, where the second expanded state 502*b* exhibits a larger diameter than the first unexpanded state 502*a*, and the third expanded state 502*c* exhibits a larger diameter than the second expanded state 502*b*. It will be appreciated that the illustrated sealing structure 112 may be representative of a sealing structure 112 that forms part of either an end section 106*a* or a middle section 106*b*, as described above with reference to FIG. 1, and without departing from the scope of the disclosure.

As illustrated, the sealing structure 112 may be made of a corrugated material, such as metal (or another material), thereby defining a plurality of contiguous, expandable folds 504 (i.e., corrugations). Those skilled in the art will readily appreciate that corrugated tubing may simplify the expansion process of the sealing structure 112, extend the ratio of potential expansion diameter change, reduce the energy required to expand the sealing structure 112, and also allow for an increased final wall thickness as compared with related prior art applications which stretch the material to obtain expansion. Moreover, as illustrated, the sealing structure 112 may have a sealing element 506 disposed about its outer radial surface. The sealing element 506 may be similar to the sealing element 208 of FIGS. 2A-2B, and therefore will not be described again in detail. In some embodiments, the sealing element 506 may be omitted.

In the first unexpanded state 502*a*, the sealing structure 112 is in its compressed configuration and able to be run into the open hole section 102 of the wellbore 104 via the production tubing 108 (FIG. 1). The folds 504 allow the sealing structure 112 to be compacted into the contracted configuration, but also allow the sealing structure 112 to expand as the folds flatten out during expansion. For reference, the truss structure 114 is also shown in the first unexpanded state 502*a*. As described above, the truss structure 114 may also be able to be run into the open hole section 102 through the existing production tubing 108 and is therefore shown in FIG. 5 as having essentially the same diameter as the sealing structure 112 in their respective contracted configurations. However, in embodiments where the truss structure 114 is run into the wellbore 104 simultaneously with the sealing structure 112, the diameter of the truss structure 114 in its contracted configuration would be smaller than as illustrated in FIG. 5. Indeed, in such embodiments, the truss structure 114 would exhibit a diameter in its contracted configuration small enough to be accommodated within the interior of the sealing structure 112.

In the second expanded state 502*b*, the sealing structure 112 may be expanded to an intermediate diameter (e.g., a diameter somewhere between the contracted and fully expanded configurations). As illustrated, in the second expanded state 502*b*, various peaks and valleys may remain in the folds 504 of the sealing structure 112, but the amplitude of the folds 504 is dramatically decreased as the material is gradually flattened out in the radial direction. In one or more embodiments, the intermediate diameter may be a predetermined diameter offset from the inner radial surface of the open hole section 102 or a diameter where the sealing structure 112 engages a portion of the inner radial surface of the open hole section 102.

Where the sealing structure 112 engages the inner radial surface of the open hole section 102, the sealing element 506 may be configured to seal against said surface, thereby preventing fluid communication either uphole or downhole with respect to the sealing structure 112. In some embodiments, the sealing element 506 may be swellable or otherwise configured to expand in order to seal across a range of varying diameters in the inner radial surface of the open hole section 102. Such swelling expansion may account for abnormalities in the wellbore 104 such as, but not limited to, collapse, creep, washout, combinations thereof, and the like. As the sealing element 506 swells or otherwise expands, the valleys of the sealing structure 112 in the second expanded state 502*b* may be filled in.

In the third expanded state 502*c*, the sealing structure 112 may be expanded to its fully expanded configuration or diameter. In the fully expanded configuration the peaks and valleys of the folds 504 may be substantially reduced or eliminated altogether. Moreover, in the expanded configuration, the sealing structure 112 may be configured to engage or otherwise come in close contact with the inner radial surface of the open hole section 102. As briefly discussed above, in some embodiments, the sealing element 506 may be omitted and the sealing structure 112 itself may instead be configured to sealingly engage the inner radial surface of the open hole section 102.

Referring now to FIGS. 6A-6D, with continued reference to FIGS. 1 and 4A-4D, illustrated are progressive views of building or otherwise extending the axial length of a downhole completion system 600 within an open hole section 102 of the wellbore 104, according to one or more embodiments of the disclosure. As illustrated, the system 600 includes a first section 602 that has already been successively installed within the wellbore 104. The first section 602 may correspond to an end section 106*a* (FIG. 1) and, in at least one embodiment, its installation may be representative of the description provided above with respect to FIGS. 4A-4D. In particular, the first section 602 may be complete with an expanded sealing structure 112 and at least one expanded truss structure 114 arranged within the expanded sealing structure 112. Those skilled in the art, however, will readily appreciate that the first section 602 may equally be representative of an expanded or installed middle section 106*b* (FIG. 1), without departing from the scope of the disclosure.

The downhole completion system 600 may be extended within the wellbore 104 by running one or more continuation or second sections 604 into the open hole section 102 and coupling the second section 604 to the distal end of an already expanded preceding section, such as the first section 602 (e.g., either an end or middle section 106*a,b*). While the second section 604 is depicted in FIGS. 6A-6D as representative of a middle section 106*b* (FIG. 1), those skilled in the art will again readily appreciate that the second section 604 may equally be representative of an expanded or installed end section 106*a* (FIG. 1), without departing from the scope of the disclosure.

As illustrated, the conveyance device 402 may again be used to convey or otherwise transport the sealing structure 112 of the second section 604 downhole and into the open hole section 102. The diameter of the sealing structure 112 in its contracted configuration may be small enough to pass through not only the existing production tubing 108 (FIG. 1), but the expanded first section 602. The sealing structure 112 of the second section 604 is run into the wellbore 104 in conjunction with the deployment device 404 which may be used to radially expand the sealing structure 112 upon actuation.

In one or more embodiments, the sealing structure 112 of the second section 604 may be run through the first section 602 such that the proximal connection section 204*a* of the second section 604 axially overlaps the distal connection section 204*b* of the first section 602 by a short distance. In other embodiments, however, as discussed in greater detail below, the adjacent sections 602, 604 do not necessarily axially overlap at the adjacent connection sections 204*a,b* but may be arranged in an axially-abutting relationship or even offset a short distance from each other, without departing from the scope of the disclosure.

Figure 6A:
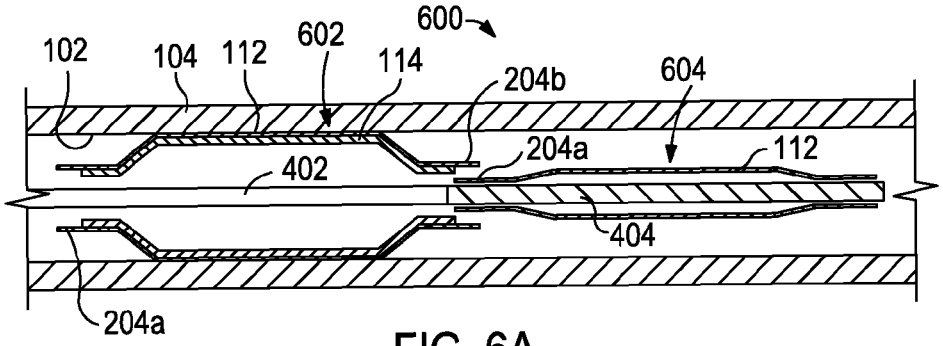
FIGS. 6A-6D illustrate progressive views of building the downhole completion system of FIG. 1 within an open hole section of a wellbore, according to one or more embodiments.
Figure 6B:
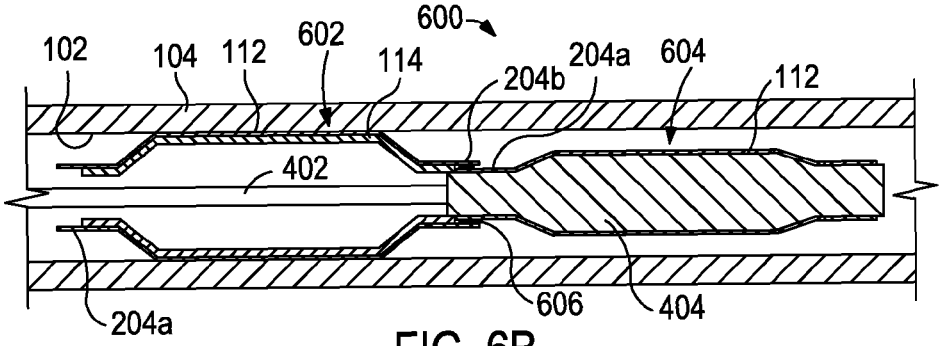

Referring to FIG. 6B, illustrated is the expansion of the sealing structure 112 of the second section 604 using the deployment device 404. In some embodiments, the sealing structure 112 of the second section 604 may be expanded to contact the inner radial surface of the open hole section 102 and potentially form a seal therebetween. In such embodiments, a sealing element (not shown), such as the sealing element 208 of FIGS. 2A and 2B, may be disposed about the outer radial surface of the sealing structure 112 in order to provide a seal over that particular area in the wellbore 104. In other embodiments, as illustrated, the sealing structure 112 is expanded to a smaller diameter. In such embodiments, no sealing element is required, thereby allowing for a thicker wall material and also minimizing costs.

As the sealing structure 112 of the second section 604 expands, its proximal connection section 204*a* expands radially such that its outer radial surface engages the inner radial surface of the distal connection section 204*b* of the first section 602, thereby forming a mechanical seal therebetween. In other embodiments, a sealing element 606 may be disposed about one or both of the outer radial surface of the proximal connection section 204*a* or the inner radial surface of the distal connection section 204*b*. The sealing element 606, which may be similar to the sealing element 208 described above (i.e., rubber, elastomer, swellable, non-swellable, etc.), may help form a fluid-tight seal between adjacent sections 602, 604. In some embodiments, the sealing element 606 serves as a type of glue between adjacent sections 602, 604 configured to increase the axial strength of the system 600.

Figure 6C:
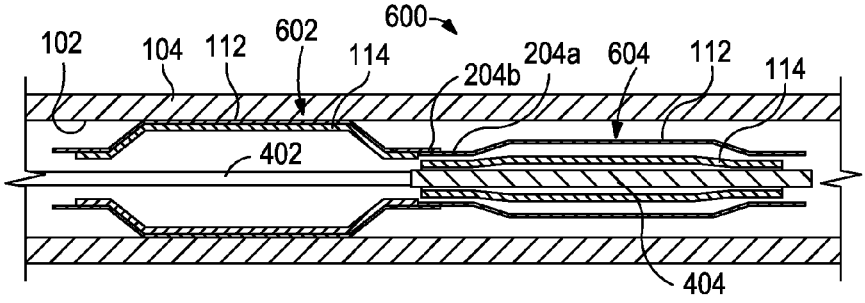

Referring to FIG. 6C, illustrated is a truss structure 114 in its contracted configuration being run into the wellbore 104 and the expanded sealing structure 112 of the second section 604 using the conveyance device 402. In its contracted configuration, the truss structure 114 exhibits a diameter small enough to traverse both the production tubing 108 (FIG. 1) and the preceding first section 602 without causing obstruction. In some embodiments, the truss structure 114 may be run in contiguously or otherwise nested within the sealing structure 112 in a single run-in into the wellbore 104. In other embodiments, however, as illustrated herein, the truss structure 114 may be run into the open hole section 102 independently of the sealing structure 112.

Figure 6D:
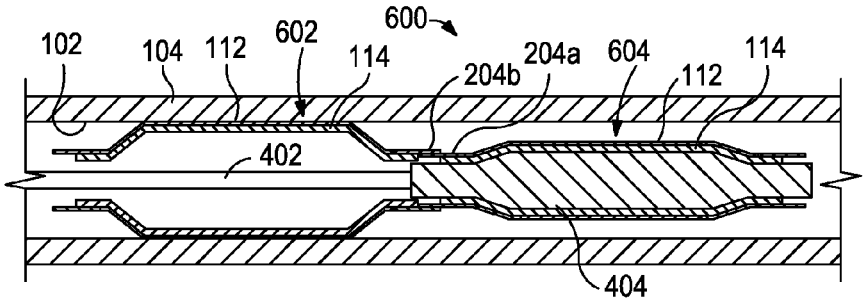

Referring to FIG. 6D, illustrated is the truss structure 114 as being expanded within the sealing device 112 using the deployment device 404. In its expanded configuration, the truss structure 114 provides radial support to the sealing structure 112 and may help prevent wellbore 104 collapse in the open hole section 102, where applicable.

Figure 7:
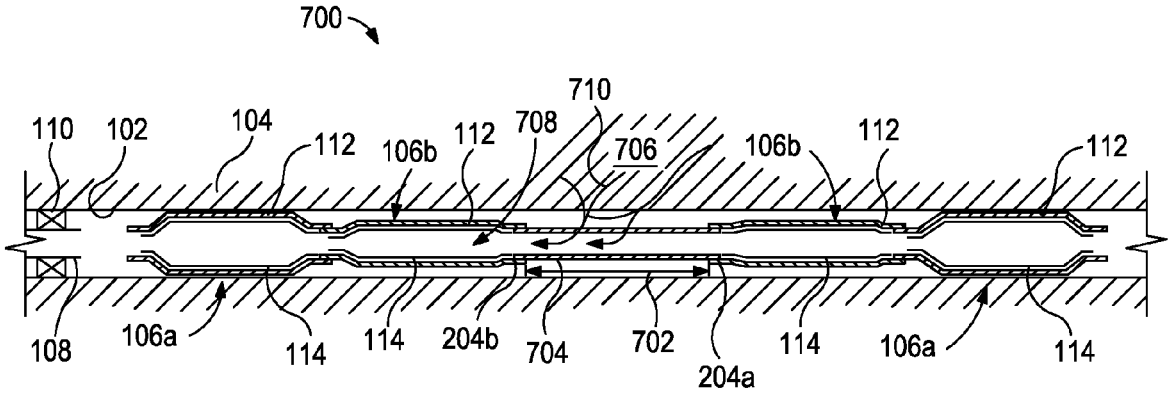
FIG. 7 illustrates another exemplary downhole completion system, according to one or more embodiments.

Referring now to FIG. 7, illustrated is another exemplary downhole completion system 700, according to one or more embodiments. The downhole completion system 700 may be similar in some respects to the downhole completion system 100 of FIG. 1, and therefore may be best understood with reference thereto where like numerals indicate like elements not described again in detail. As illustrated, the system 700 may include at least two expanded end sections 106*a* and at least two expanded middle sections 106*b*, but those skilled in the art will readily recognize that more or less than two end and/or middle sections 106*a,b* may be employed, without departing from the scope of the disclosure. In some embodiments, one or more of the expanded end and/or middle sections 106*a,b* may include only the expanded sealing structure 112, and the expanded truss structure 114 may otherwise be omitted from the particular section 106*a,b*, without departing from the scope of the disclosure.

In the illustrated embodiment, the uphole portions of the system 700 (i.e., to the left in FIG. 7) are arranged axially adjacent or otherwise proximate to the downhole portions of the system 700 (i.e., to the right in FIG. 7). In particular, the uphole portions of the system 700 are axially offset a distance from the downhole portions of the system 700, thereby defining a gap 702 therebetween. In some embodiments, an additional sealing structure 112 or other tubular member may be arranged longitudinally between axially adjacent portions of the system 700 and otherwise configured to span the gap 702. As such a direct fluid conduit may be provided between the axially adjacent portions of the system 700.

In other embodiments, however, the system 700 may further include one or more flow control devices 704 arranged longitudinally between and otherwise configured to span the gap 702 between the axially adjacent portions of the system 700. Accordingly, in at least one embodiment, the distance between the axially adjacent portions of the system 700 may be configured as a predetermined distance, and the flow control device 704 may be configured to functionally straddle the predetermined distance and thereby provide a connection between the adjacent axial portions of the system 700. The predetermined distance between the adjacent portions of the system 700 which defines the gap 702 may range from less than an inch to several joints of tubing, depending on the application and constraints of the system 700.

The flow control device 704 may provide a planned flow path for fluids 710 to communicate therethrough between the surrounding subterranean formation 706 and the interior 708 of the system 700. As such, the flow control device 704 may allow the influx (or outflow in injection applications) of fluids therethrough and may be, but is not limited to, a flow control device, an inflow control device (passive or active), an autonomous inflow control device, a valve, an expansion valve, a sleeve, a sliding sleeve, a filter (e.g., a sand filter), combinations thereof, or the like. In at least one embodiment, the flow control device 704 may be the EQUIFLOW® autonomous inflow control device commercially available from Halliburton Energy Services of Houston, Tex., USA. In exemplary operation, the flow control device 704 may provide the option of preventing or otherwise restricting fluid flow into the interior of the system 700 at that particular point.

The flow control device 704 may be remotely controlled by an operator via wired or wireless communication techniques known to those skilled in the art. In some embodiments, the operator may remotely control the flow control device 704 from a remote geographic location away from the site of the downhole completion system 700 using wired, wireless, or satellite telecommunications. The system 700 may further employ battery-powered or flow-powered devices (not shown) for telemetry, monitoring, and/or control of the flow control device 704. A computer (not shown) having a processor and a computer-readable medium may be communicably coupled to the flow control device 704 and configured to autonomously operate or actuate the flow control device 704 in response to a signal perceived from the battery-powered or flow-powered devices. As will be appreciated by those skilled in the art, suitable actuators or solenoids (not shown) may be used to manipulate the flow rate of the flow control device 704 as directed by the computer or processor.

In some embodiments, the flow control device 704 may be expandable between contracted and expanded configurations, and installing the flow control device 704 in the system 700 may be similar to the installation of the end or middle sections 106*a,b*. For instance, the flow control device 704 in its contracted configuration may be conveyed or otherwise transported downhole and into the open hole section 102 using the conveyance device 402 (FIGS. 4A-4D). The diameter of the flow control device 704 in its contracted configuration may be small enough to pass through not only the existing production tubing 108, but also the expanded sections of the system 700. The flow control device 704 may be run into the wellbore 104 in conjunction with the deployment device 404 (FIGS. 4A-4D) which may be used to radially expand the flow control device 704 upon actuation. In other embodiments, however, the flow control device 704 may not require expansion nor be configured for such.

In one or more embodiments, the flow control device 704 may be configured to locate the gap 702 such that it axially overlaps a proximal connection section 204*a* of a downhole end of the system 700 and a distal connection section 204*b* of an uphole end of the system 700. Specifically, as illustrated, the flow control device 704 is arranged at the gap 702 such that it axially overlaps the proximal connection section 204*a* of the middle section 106*b* corresponding to the downhole portion of the system 700 and the distal connection section 204*b* of the middle section 106*b* corresponding to the uphole end of the system 700. As the flow control device 704 expands radially, its opposing ends expand to engage the inner radial surface of the corresponding proximal and distal connection sections 204*a,b*. In some embodiments, a mechanical seal is formed at each contact point between the flow control device 704 and the corresponding proximal and distal connection sections 204*a,b*. In other embodiments, however, a sealing element, such as the sealing element 606 of FIG. 6B, may be disposed about one or both of the outer radial surface of each end of the flow control device 704 and/or the respective inner radial surfaces of the proximal and distal connection sections 204*a,b*. The sealing element 606 (FIG. 6B), may help form a fluid-tight seal between the flow control device 704 and the respective inner radial surfaces of the proximal and distal connection sections 204*a,b*.

Figure 8:
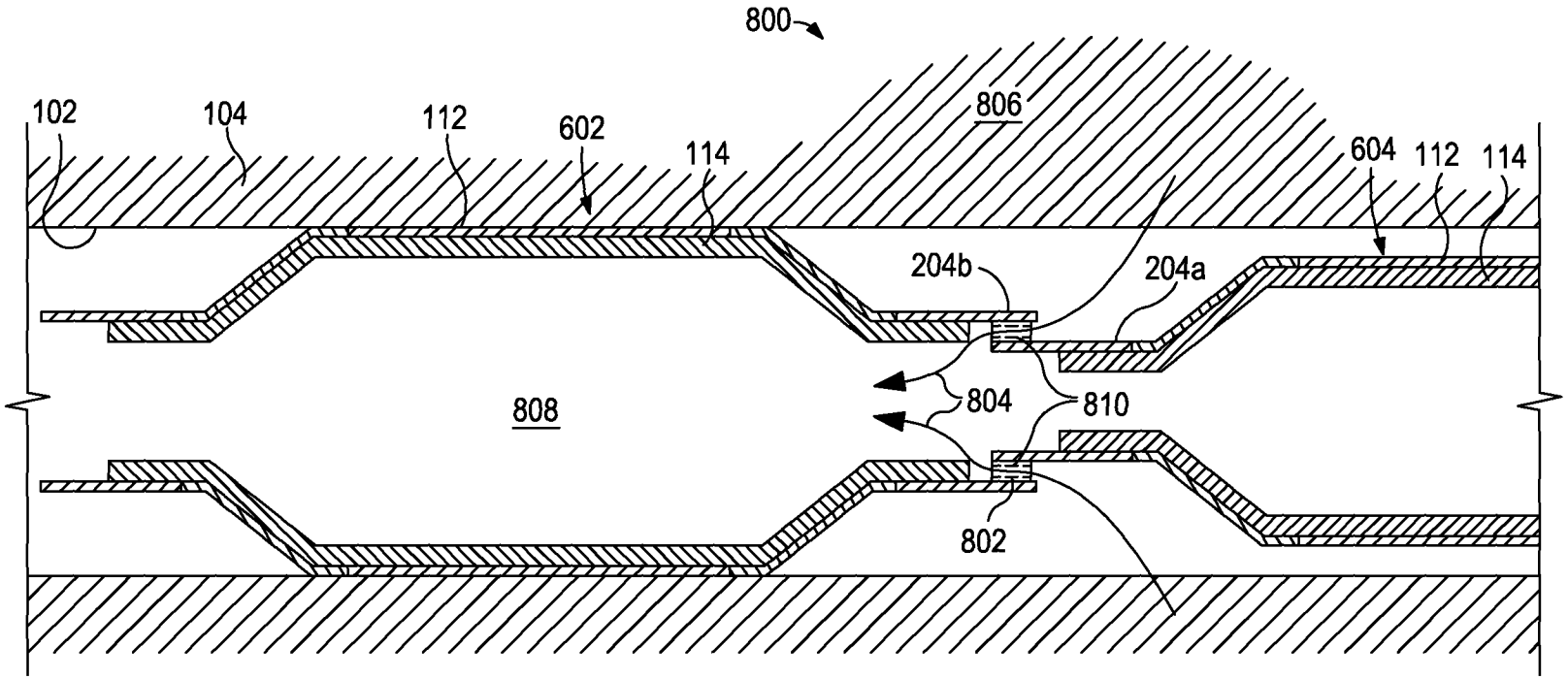
FIG. 8 illustrates another exemplary downhole completion system, according to one or more embodiments.

Referring now to FIG. 8, illustrated is another exemplary downhole completion system 800, according to one or more embodiments. The downhole completion system 800 may be similar in some respects to the downhole completion system 600 of FIGS. 6A-6D, and therefore may be best understood with reference thereto where like numerals indicate like elements not described again in detail. As illustrated, the system 800 includes a first section 602 arranged axially adjacent a second section 604, where the first and second sections 602, 604 have been successively installed within the wellbore 104. In some embodiments, the first section 602 may correspond to an end section 106*a* (FIG. 1) and the second section 604 may correspond to a middle section 106*b* (FIG. 1). In other embodiments, however, the first section 602 may correspond to either an end or middle section 106*a,b* and, likewise, the second section 604 may correspond to either an end or a middle section 106*a,b*, without departing from the scope of the disclosure.

Both the first and second sections 602, 604 may be complete with an expanded sealing structure 112 and at least one expanded truss structure 114 arranged within the corresponding expanded sealing structure 112. In other embodiments, however, one or both of the expanded first or second sections 602, 604 may include only the expanded sealing structure 112, and the expanded truss structure 114 may otherwise be omitted from the respective section 602, 604, without departing from the scope of the disclosure.

The system 800 may further include a flow control device 802 arranged radially between or otherwise radially interposing the proximal connection section 204*a* and the distal connection section 204*b* of the first and second sections 602, 604, respectively. In particular, the flow control device 802 may be radially expanded as a portion of either the first or second sections 602, 604. Accordingly, the flow control device 802 may be disposed about one of the outer radial surface of the proximal connection section 204*a* or the inner radial surface of the distal connection section 204*b*. In either case, once the first and second sections 602, 604 are properly expanded, the flow control device 802 may provide a planned flow path for fluids 804 to communicate between the surrounding subterranean formation 806 and the interior 808 of the system 800.

As illustrated, the flow control device 802 may define one or more conduits 810 (two shown) extending axially therethrough that allow the communication of fluids 804 therethrough. While only two conduits 810 are illustrated in FIG. 8, it will be appreciated that more than two conduits 810 (or only one conduit 810) may be employed, without departing from the scope of the disclosure. The flow control device 802 may be an expandable or flexible device and, in some embodiments, may be, but is not limited to, a flow control device, an inflow control device, an autonomous inflow control device, a valve (e.g., expandable, expansion, etc.), a sleeve, a sleeve valve, a sliding sleeve, a filter (e.g., a sand filter), a flow restrictor, a check valve (operable in either direction, in series or in parallel with other check valves, etc.), combinations thereof, or the like. In exemplary operation, the flow control device 802 may provide the option of preventing or otherwise restricting fluid flow 804 into the interior of the system 800 at that particular point. Alternatively, the flow control device 802 may be configured to regulate fluid flow 804 out of the interior of the system 800, such as in an injection operation.

Accordingly, production and/or injection operations can be intelligently controlled via the flow control device 802. In some embodiments, production/injection operations may be controlled by flow rate or pressure loss, or both. In other embodiments, the production/injection operations may be restricted by several parameters of the fluid flow 804 such as, but not limited to, the flow rate, fluid density, viscosity, conductivity, or any combination of these. The controls, instructions, or relative configuration of the flow control device 802 (e.g., valve position between open and closed positions) may be changed by wire line intervention, or other standard oilfield practices as well as by intervention-less methods known to those skilled in the oil field completion technology.

Similar to the flow control device 704 of FIG. 7, the flow control device 802 may be remotely controlled by an operator (either wired or wirelessly) through means of a computer (not shown) communicably coupled to the flow control device 802. The computer may have a processor and a computer-readable medium and, in some embodiments, may be configured to autonomously operate or actuate the flow control device 802 in response to a signal perceived from an adjacent battery-powered or flow-powered device. Suitable actuators or solenoids (not shown) may be also used to manipulate the flow rate of the flow control device 802 as directed by the computer or processor.

While not shown, it is also contemplated in the present disclosure to arrange one or more flow control devices 802 in or about one or more sealing elements 208 (FIGS. 2A, 2B, and 4A-4D). In particular, a flow control device 802 may be arranged or otherwise placed in or in-between one or more sealing elements 208 disposed about the outer radial surface of a sealing structure 112 (end or middle section). The flow control device 802 may be configured to provide fluid communication between the formation 706, 806 and the interior of the particular sealing structure 112.

Those skilled in the art will readily appreciate the several advantages the disclosed systems and methods may provide. For example, the disclosed downhole completion systems are able to be run through existing production tubing 108 (FIG. 1) and then assembled in an open hole section 102 of the wellbore 104. Accordingly, the production tubing 108 is not required to be pulled out of the wellbore 104 prior to installing the downhole completion systems, thereby saving a significant amount of time and expense. Another advantage is that the downhole completion systems can be run and installed without the use of a rig at the surface. Rather, the downhole completion systems may be extended into the open hole section 102 entirely on wireline, slickline, coiled tubing, or jointed pipe. Moreover, it will be appreciated that the downhole completion systems may be progressively built either toward or away from the surface within the wellbore 104, without departing from the scope of the disclosure. Even further, the final inner size of the expanded sealing structures 112 and truss structures 114 may allow for the conveyance of additional lengths of standard diameter production tubing through said structures to more distal locations in the wellbore.

Another advantage is that the downhole completion systems provide for the deployment and expansion of the sealing and truss structures 112, 114 in separate runs into the open hole section 102 of the wellbore 104. As a result, the undeployed downhole completion systems are able to pass through a much smaller diameter of production tubing 108 and there would be less weight for each component that is run into the wellbore 104. Moreover, this allows for longer sections to be run into longer horizontal portions of the wellbore 104. Another advantage gained is the ability to increase the material thickness of each structure 112, 114, which results in stronger components and the ability to add additional sealing material (e.g., sealing elements 208).

Yet another advantage gained by the disclosed downhole completion systems is the intelligent production and injection capabilities afforded by the disclosed flow control devices 704, 802. Whether arranged radially or longitudinally between axially adjacent sections 604, 602 of a downhole completion system, the flow control devices 704, 802 may provide a planned flow path for fluids to communicate between the surrounding subterranean formation and the interior 808 of the downhole completion system. Such flow control devices 704, 802 may be manually or autonomously operated in order to optimize hydrocarbon production.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patents or other documents that may be incorporated herein by reference, the definitions that are consistent with this specification should be adopted.

What is claimed is:

1. A downhole completion system to be arranged within an open hole section of a wellbore, comprising:

a first sealing structure configured to be expanded from a contracted configuration to an expanded configuration;

a second sealing structure configured to be expanded from a contracted configuration to an expanded configuration and arranged proximally from the first sealing structure; and a flow control device radially disposed between the first and second sealing structures and providing a flow path for fluids, wherein the flow control device defines one or more conduits extending through the flow control device, the one or more conduits providing at least a portion of the flow path for fluids to communicate between the surrounding subterranean formation and the interior of the first and second sealing structures.

2. The system of claim 1, wherein the first sealing structure has a proximal connection section and the second sealing structure has a distal connection section, and wherein the flow control device engages an outer radial surface of the proximal connection section and an inner radial surface of the distal connection section.

3. The system of claim 1, wherein the flow control device comprises one or more flow control devices selected from the group consisting of an inflow control device, an autonomous inflow control device, a valve, a sleeve, a filter, and any combination thereof.

4. The system of claim 3, wherein a flow rate of the flow control device is remotely controlled.

5. The system of claim 1, further comprising at least one truss structure configured to be arranged at least partially within at least one of the first and second sealing structures and expanded from a contracted configuration to an expanded configuration.

6. The system of claim 5, further comprising:

a conveyance device configured to transport the first and second sealing structures and the at least one truss structure in their respective contracted configurations through the production tubing and to an open hole section of the wellbore; and a deployment device configured to radially expand the first and second sealing structures and the at least one truss structure from their respective contracted configurations to their respective expanded configurations.

7. The system of claim 6, wherein the at least one truss structure radially supports at least one of the first and second sealing structures in the expanded configuration.

8. The system of claim 5, wherein the at least one truss structure comprises a plurality of expandable cells that facilitate expansion of the at least one truss structure from the contracted configuration to the expanded configuration.

9. The system of claim 8, wherein at least some of the plurality of expandable cells comprise a thin strut connected to a thick strut, and wherein a respective axial length of the at least one truss structure in the contracted and expanded configurations is generally the same.

10. A method of completing an open hole section of a wellbore, comprising:

conveying a first sealing structure in a contracted configuration to the open hole section with a conveyance device;

radially expanding the first sealing structure from the contracted configuration to an expanded configuration with a deployment device;

conveying a second sealing structure in a contracted configuration to the open hole section with the conveyance device;

arranging the second sealing structure adjacent the first sealing structure such that a proximal connection section of the second sealing structure is radially offset from a distal connection section of the first sealing structure;

radially expanding the second sealing structure from the contracted configuration to an expanded configuration with the deployment device; and providing a flow path for fluids with a flow control device that radially interposes the proximal and distal connection sections.

11. The method of claim 10, further comprising sealing an engagement between a first connection section of the second sealing structure and a second connection section of the first sealing structure with at least one sealing element.

12. The method of claim 10, further comprising:

conveying at least one truss structure in a contracted configuration to the open hole section with the conveyance device;

radially expanding the at least one truss structure from the contracted configuration to an expanded configuration with the deployment device while the at least one truss structure is arranged at least partially within at least one of the first and second sealing structures.

13. The method of claim 12, further comprising conveying the first and second sealing structures and the at least one truss structure in their respective contracted configurations through production tubing arranged within the wellbore.

14. The method of claim 13, further comprising radially supporting at least one of the first and second sealing structures with the at least one truss structure in the expanded configuration.

15. The method of claim 12, wherein radially expanding the at least one truss structure into the expanded configuration further comprises expanding a plurality of expandable cells defined on the at least one truss structure.

16. The method of claim 15, wherein expanding the plurality of expandable cells further comprises radially expanding the at least one truss structure such that a respective axial length of the at least one truss structure in the corresponding contracted and expanded configurations is generally the same, and wherein at least one of the plurality of expandable cells comprises a thin strut connected to a thick strut.

* * * * *